United States Patent [19]

Sälzer

[11] Patent Number: 4,612,743

[45] Date of Patent: Sep. 23, 1986

[54] FRAME CONSTRUCTION AND PROFILE SECTIONS FORMING SAME

[76] Inventor: Heinrich Sälzer, Industriestrasse 4, 3550 Marburg, Wehrda, Fed. Rep. of Germany

[21] Appl. No.: 735,800

[22] Filed: May 17, 1985

[30] Foreign Application Priority Data

May 24, 1984 [DE] Fed. Rep. of Germany ..... 3419413

[51] Int. Cl.[4] ..... E06B 3/05; E06B 3/26

[52] U.S. Cl. ..... 52/208; 49/501; 49/504; 52/397; 52/656; 52/824; 52/825

[58] Field of Search ..... 52/208, 397, 398, 824, 52/825, 656; 49/501, 504

[56] References Cited

U.S. PATENT DOCUMENTS

| | | | |
|---|---|---|---|
| 981,972 | 1/1911 | Bonness | 52/825 |
| 1,897,476 | 2/1933 | Himmel et al. | 52/397 |
| 2,163,566 | 6/1938 | Blessin | 52/208 |
| 2,856,041 | 10/1958 | Santheim | 52/208 |
| 3,274,735 | 9/1966 | Stackhouse | 49/504 |
| 3,411,247 | 11/1968 | Fleming | 49/501 |
| 3,545,134 | 12/1970 | Dargene | 49/501 |
| 3,566,565 | 3/1971 | Pond | 52/208 |
| 3,774,345 | 11/1973 | Cole et al. | 49/504 |
| 3,918,231 | 11/1975 | Kessler | 52/824 X |

FOREIGN PATENT DOCUMENTS

| | | | |
|---|---|---|---|
| 1273783 | 7/1968 | Fed. Rep. of Germany | 52/208 |
| 1683716 | 11/1969 | Fed. Rep. of Germany | 52/208 |
| 203386 | 10/1938 | Switzerland | 52/824 |
| 1406537 | 9/1975 | United Kingdom | 52/397 |

*Primary Examiner*—Alfred C. Perham
*Attorney, Agent, or Firm*—Arthur B. Colvin

[57] ABSTRACT

A frame construction and profile parts for forming same is comprised of a pair of interfitting rigid sections which are mutually connectable to define a U-shaped configuration for supporting a panel. One of the profile parts includes an inwardly facing chamber for receiving corners connecting adjacent frame legs, the chamber opening toward the panel so that the mounted panel covers the fasteners securing the corners. The profile part includes an outwardly facing and outwardly opening chamber for receiving mounting hardware.

5 Claims, 6 Drawing Figures

FRAME CONSTRUCTION AND PROFILE SECTIONS FORMING SAME

Figure 1:
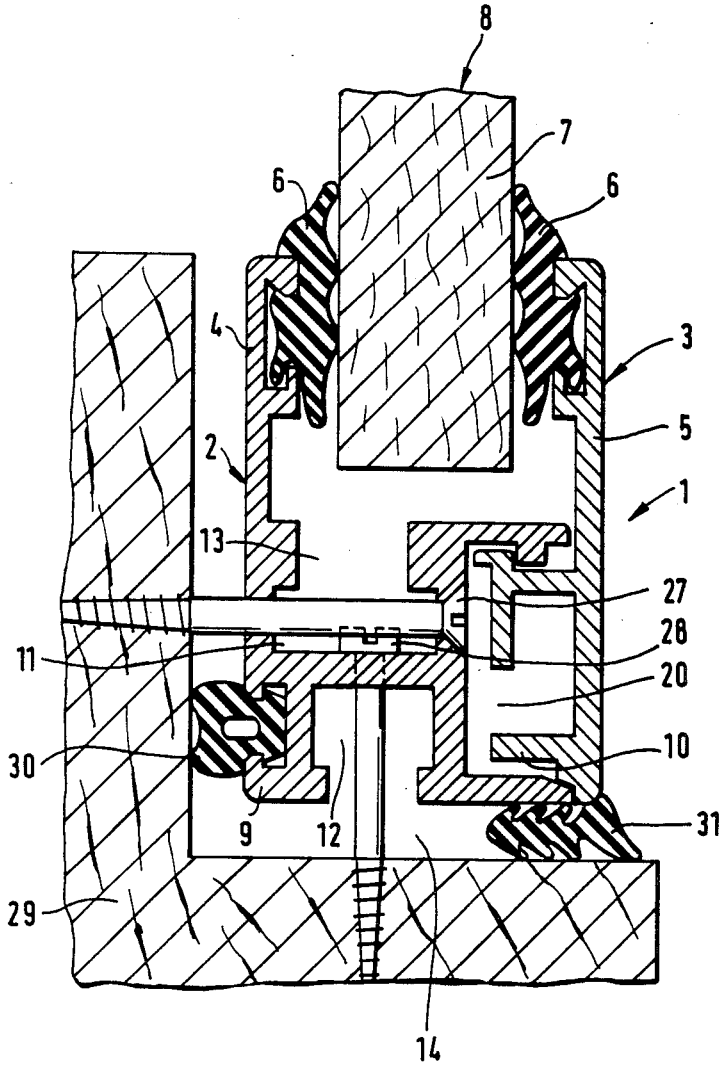

This invention relates to a frame of frame legs interconnected by corner angles for forming structural parts provided with a panel shaped filling or fillings, e.g. casement doors and windows. Edge strips of the filling are framed by essentially U-shaped hollow sections which form the frame legs and in whose webs corner angle legs are insertable and fixable.

When generally known frames of single-piece frame legs are used, the panel shaped filling must be put in place before the frame made up of the frame legs is assembled. Consequently, screwing the corner angles to the frame legs can be accomplished only from a frame side still accessible after the panel shaped filling was put in place. To prevent unauthorized unscrewing of the corner angle screws, they are preferably so disposed as to be inaccessible from the frame faces so that unscrewing the screws in the closed position of a casement door or window is precluded.

But screwing the corner angles over the frame faces necessitates an arrangement of the corner angles in the outside area of the hollow profile webs. Therefore, this area is available only to a limited extent of the accommodation of other structural parts, such as filler parts to fasten casement bands (hinges). But when a wing is open, unauthorized unscrewing of the crews is possible except for the frame leg provided with the bands (hinges) so that at least some corner angles can be removed in unnoticed preparation of a break-in or break-out. The known corner angle screw fastenings are thus unsuited, especially for safety doors and windows, to meet high security requirements.

It is an object of the invention to create a frame for fixed or pivotable structure parts such as casement doors and windows provided with a panel shaped filling where the frame legs are interconnected by corner angles whose screws are accessible from no outside frame surface after the filling is inserted, with no special treatment of the frame legs required due to the hidden arrangement of the screws.

It is another object of the invention to create a profile section for the fastening of a panel shaped filling inserted in a frame, said profile section to be particularly safe and easy to install, utilizing the elasticity of the elastic sealing strips.

To solve this problem there is provided a frame construction comprised of two profiles, one said profile including an inner chamber having an inwardly facing opening for receiving corner support, and an outer chamber having an outwardly facing opening for mounting a hinge or the like.

Due to the inventive assembly of the hollow sections forming the frame legs, each using two essentially angular profiled parts, four identical hollow sections can be put together to form one frame half, the corner angle legs beng insertable into the profile parts chamber whose longitudinal opening points towards the frame center. Thereupon, the panel shaped filling can be inserted into the frame halves, thereby blocking access to the screws which fasten the corner angle legs. Since the screws can be screwed into tapped holes in the corner angle legs through longitudinal openings of the respective profile parts pointing towards the filling, the profile parts need no additional machining such as the drilling of holes to obtain access to the tapped holes in the corner angle legs. A screw point pressing against the chamber floor prevents the corner angle from shifting later, and it is additionally kept in its exact position in the chamber in that the corner angle leg is pressed by the screw against the side of the chamber opposite the chamber floor, which chamber side has a longitudinal opening. When the assembly of one frame half is thus completed and the panel shaped filling then inserted in it, the profile parts whose legs complete the hollow section web can be placed on the frame half, thereby completing the frame.

The resiliency of the elastic sealing strips disposed laterally on the edge strips of the filling exerts a torque against the assembled profile parts which can be utilized to join the profile parts together.

The inventive arrangement of the chamber accommodating the corner angles within the web area facing the face of the filling results in the further advantage that space remains available in the web area facing away from the face of the filling to accommodate the second chamber for the accommodation of threaded parts. This makes it possible to introduce screws, even after the frame is assembled, through the longitudinal chamber opening pointing away from the face of the filling to fix the threaded parts in the second chamber in the same or a similar manner as the corner angle legs in the first chamber. In this way it is possible to fasten hinges, for example, to a leg of a structural part designed as casement frame without requiring any machining of the hollow section forming the respective leg.

According to one embodiment of the invention, a leg of one profile part forming the web of the section has a longitudinal slot which is open on the face and is engaged by a leg of the other profile art complementing the web of the section.

Due to this design, the legs forming the web of the hollow section can be interconnected by screws or also by detents, the detents leading to a firm connection of the profile parts on account of the resiliency of the elastic sealing strips, even at liberal tolerances.

According to a modified embodiment of the invention, the profile part legs forming the web of the hollow section may also overlap, however, and an extension of the one profile part may cover the leg face of the other profile part.

This embodiment affords the possibility to interconnect the profile parts by screws aligned selectively in planes perpendicular to each other.

In order to construct frames from panel shaped fillings differing in thickness from the same profile parts, a particularly advantageous embodiment of the invention provides that at least one of the profile part legs forming the web can be shortened.

Due to the shortenability of the one and/or the other of the legs forming the web, U-shaped hollow sections for the frame legs can be assembled of the profile parts which are adapted in particularly simple manner to the respective thickness of the filling.

Another embodiment of the invention provides further for the interposition of a piece of heat insulating material between the legs of the profile parts.

The heat insulating material is expediently placed between the profile part leg faces forming the hollow section web. The inside width of the U-shaped hollow section can also be varied for the accommodation of fillings of different thickness by dimensioning the frame part formed of the heat insulating material differently.

The fastening of a panel shaped filling inserted in a frame is served by a profile part of essentially U-shaped cross section, one leg of which engages a slot in a frame part whereas another leg makes a sealing strip pressable against one side of the filling. According to the invention, the leg engaging the longitudinal slot open perpendicular to the place of the panel shaped filling has an edge strip or abuttment bent towards the face of the filling and gripping behind an edge strip or detent which unilaterally constricts the open cross sectional area of the longitudinal slot, and there emanates from the leg engaging the longitudinal slot a leg aligned parallel to the filling plane and able to support itself on a surface part of at least one side-wall of the longitudinal slot.

Due to this inventive embodiment of the profile part it is possible, with the aid of the sealing strip, to utilize a torque in order to press the web aligned parallel to the filling plane against a surface part of at least one side wall of the longitudinal slot. The interaction with the bent edge strip gripping behind the edge strip unilaterally constricting the open cross-sectional area of the longitudinal slot results in a profile part fastening as simple as it is secure.

According to one embodiment of the invention one side of the web aligned parallel to the filling place can be supported by a shoulder formed on a sidewall of the longitudinal slot opposite the constricting edge strip.

The torque acting upon the profile part is utilized for fastening purposes in particularly purposeful manner by this embodiment.

But the possibility also exists, according to another embodiment of the invention, to mold to the web aligned parallel to the filling plane a supporting strip aligned perpendicular to the filling plane, its free edge being supportable by a surface part of the sidewall of the longitudinal slot.

This embodiment also results in a secure connection of the profile part to the frame part.

According to a further embodiment of the invention, the depth of the shoulder may be limited by a plane extending at a parallel spacing from the filling plane greater than the plane in which the side of the bent edge strip facing the edge strip constricting the longitudinal slot lies.

An alignment of the outside of the profile part with the respective outside of the frame part is achievable in simple manner by this embodiment.

Furthermore, the shoulder may be limited by a stepped expansion of the sidewall of the longitudinal slot, and the depth of the expansion perpendicular to the filling plane may correspond to the thickness of the web supportable by the shoulder so that any formation of steps between the profile part and the frame part is avoided, the parts instead giving the optical impression of being one unit.

Figure 2:
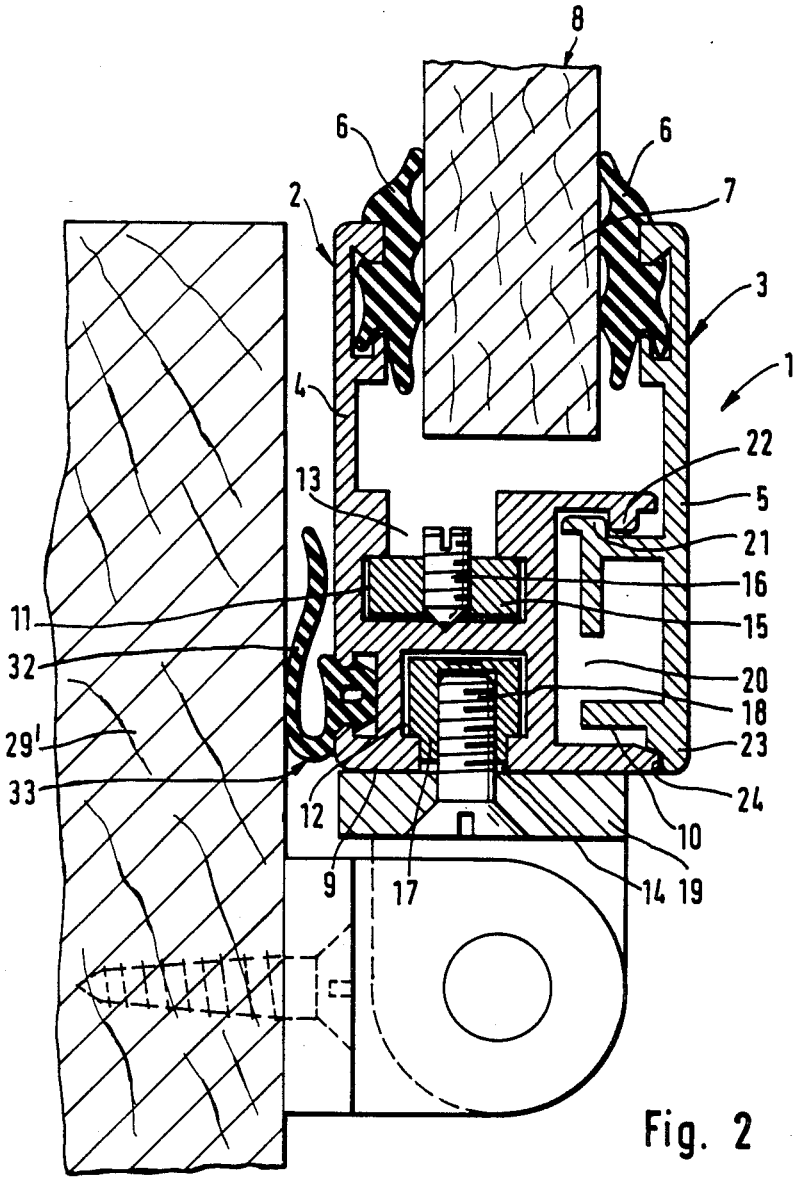
Figure 3:
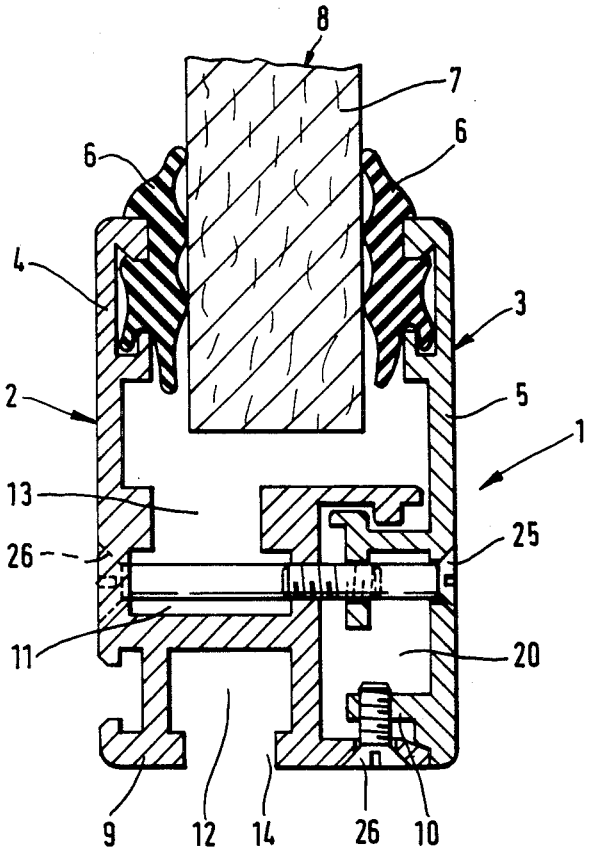
Figure 4:
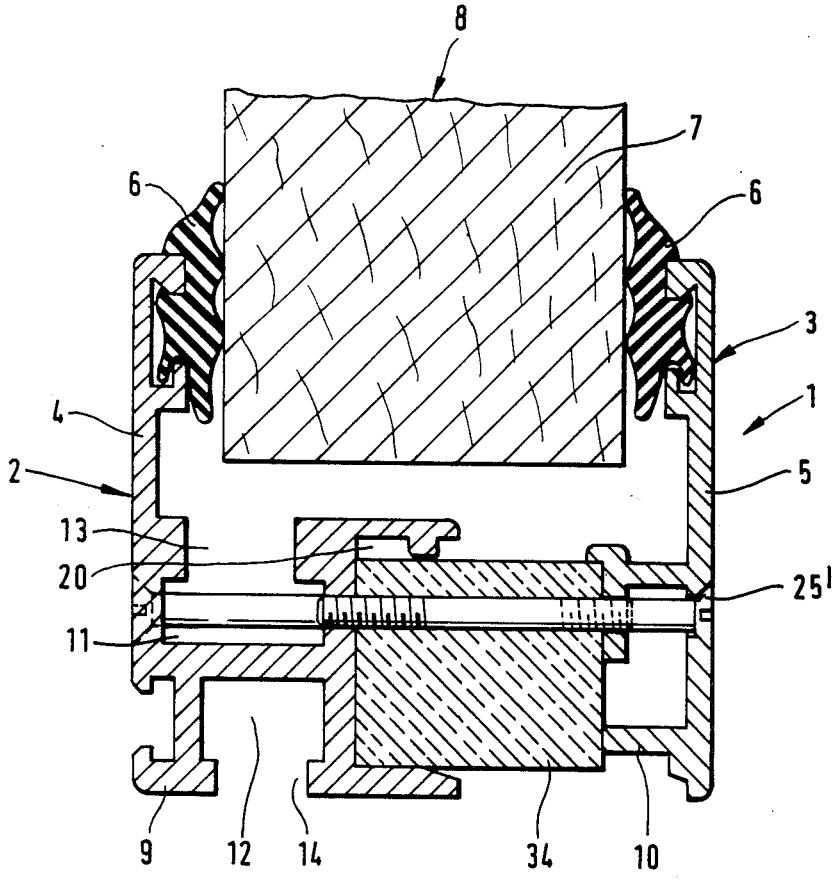
Figure 5:
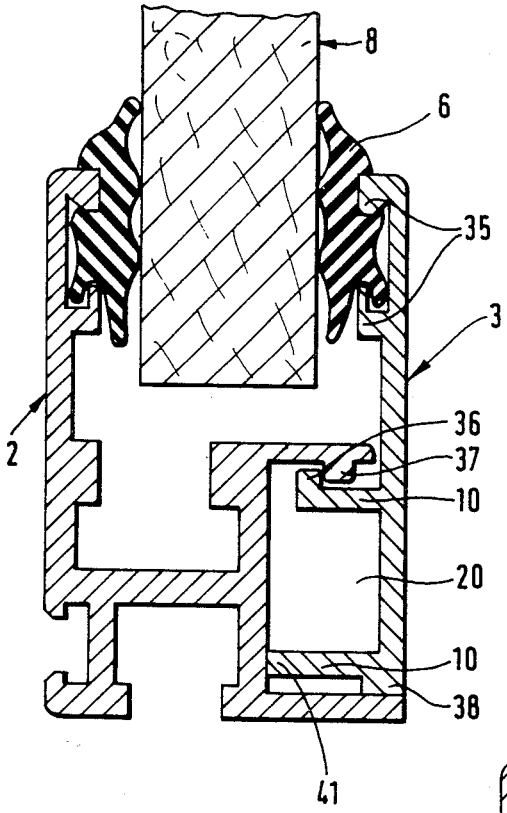
Figure 6:
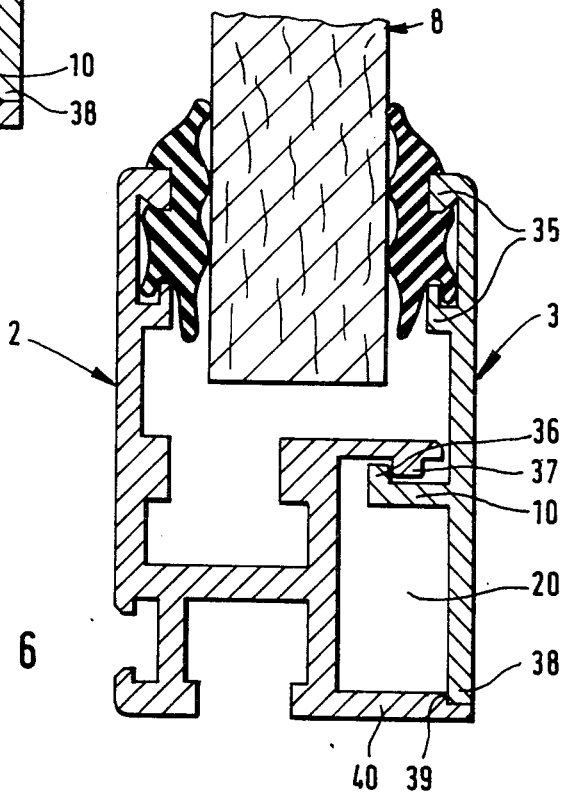

The drawing depicts in transverse section various embodiment examples of a frame leg for the formation of a frame according to the invention, shown in FIG. 1 the frame leg of a fixed frame;

FIG. 2 a leg on the hinge side of a frame for a casement door or window;

FIG. 3 a frame leg of profile parts screwed to each other;

FIG. 4 a frame leg with heat insulating material disposed betwen the profile parts;

FIGS. 5 and 6 a frame leg, each figure showing a respective embodiment of the profile part to fasten the panel shaped filling.

Referring now to the drawings, and particularly FIG. 1, a frame leg consists of an essentially U-shaped hollow section 1 assembled of two essentially angular profile parts 2 and 3.

With elastic sealing strips 6 interposed, one leg 4, 5 of the profile parts 2 and 3 frames an edge strip 7 of a panel shaped filing 8, a fragmentary portion of the filling being shown.

Two chambers 11 and 12 are accommmodated in a leg 9 of the profile part 2, the leg 9 facing the leg 10 of the profile part 3 and forming with the latter a web of the U-shaped hollow section 1. While the chamber 11 has a longitudinal opening 13 pointing towards the filling 8, the chamber 12 has a longitudinal opening 14 pointing away from the filling 8.

As FIG. 2 shows, the chamber 11 serves the accommodation of one of the legs 15 of a corner angle fastened in it by screws 16 which can be introduced through the longitudinal opening 13. As FIG. 2 shows also, the chamber 12 can accommodate threaded parts 17 in order to retain therein, through the longitudinal opening 14, a screw 18 with which a mounting member such as a hinge may be secured.

The leg 9 of the profile part 2 has a longitudinal slot 20, open at the face, into which snaps the free end of the leg 10 which is forkshaped in cross section. Due to the elastic sealing strips 6, exerting a torque upon the profile part 3, it suffices, in order to keep up the detent connection between the profile parts 2 and 3, for a protrusion 21 of the forkshaped leg 10 to grip behind a protrusion 22 of a sidewall of the longitudinal slot 20 adjacent to the edge strip 7 of the filling 8 and for an edge strip 23 to be supported by an edge 24 of an opposite sidewall of the longitudinal slot 20.

As FIG. 3 shows, the profile parts 2 and 3, however, may also be connected in addition by screws 25 and/or 26, penetrating the legs 9 and 10 perpendicularly and parallel, respectively, to the plane of the filling 8.

In the embodiment example per FIG. 1 the profile part 2 of a fixed frame is retained in an opening of structure 29 by means of screws 27 and 28 which merely penetrate the leg 9 perpendicular and parallel, respectively, to the plane of the filling 8, profiled sealing strips 30 and 31 sealing the U-shaped hollow section 1 against the structure 29.

In the embodiment example per FIG. 2 a slip 32 of a sealing strip 33, preloaded against the structure 29', seals off the U-shaped hollow section 1 of a pivotable frame.

In the embodiment example per FIG. 4 there is disposed between the faces of the legs 9 and 10 of the profile parts 2 and 3 an intermediate part 34 of heat insulating material which, in turn, is retained in the longitudinal slot 20 of leg 9 on the one hand and in the cross-sectionally forkshaped end of leg 10. In this embodiment example, the profile parts 2 and 3 must be connected by a screw 25' penetrating the legs 9 and 10 perpendicular to the filling plane. By varying the dimensions of the intermediate part 34 the U-shaped hollow section 1 thus assembled can be adapted to fillings 8 of different thicknesses.

In the embodiment example per FIG. 5 the profile part 3 again is of essentially U-shaped cross section to fasten the panel shaped fillings 8, and a pair of legs 10 engages the slot 20 of the profile part 2. Another pair of legs 35 pushes part 3 against one side of the filling 8 via the sealing strip 6.

An edge strip or abuttment 36, bent towards the face of the filling 8, grips behind an edge strip or detent 37 which unilaterally constricts the open cross section of the longitudinal slot 20. A web 38 of the profile part 3, aligned parallel to the filling plane, makes contact with a surface part of a sidewall of the longitudinal slot 20 and is supported by it.

At the web 38 aligned parallel to the filling plane the leg 10 forms a supporting strip 41 whose free edge can also be supported by a surface part of the sidewall of the longitudinal slot 20.

In the embodiment example per FIG. 6 the web 38 is supported by a shoulder 39 formed at the end of a sidewall 40 of the longitudinal slot 20.

The depth of the shoulder 39 is such that the web 38 is flush with its outside and with the face of the sidewall 40. Since the shoulder 39 is formed by a stepped expansion of the longitudinal slot 20 within the sidewall 40, a compact configuration of the profile part 3 relative to the profile part 2 results.

As will be apparent to those skilled in the art, there has been described a profile structure for forming a frame such as a door or window frame which provides a high degree of security against unauthorized disassembly since the corner configurations are inaccessible after the panel is mounted.

The construction enables mounting hardware, such as hinges, locks, etc. to be readily mounted due to the provision of outwardly open channels surrounding the frame.

Numerous variations in details of construction may occur to those skilled in the art and familiarized with the instant disclosure. Accordingly, the invention is to be broadly construed within the scope of the appended claims.

Having thus described the invention and illustrated its use, what is claimed as new and is desired to be secured by Letters Patent in the United States is:

1. A frame of frame legs for the formation of rectangular receptacles for the edge portions of panels such as windows, doors and the like each said leg comprising a pair of profiled parts adapted to be assembled to form a generally U-shaped section arranged to encompass an edge portion of a said panel, characterized in that one of said profiled parts includes a longitudinally extending first chamber opening in the direction of said edge portion of said panel, said one of said parts including in addition a second chamber opening in a direction facing away from said edge portion of said panel, a corner angle having elements disposed in said first chambers of adjacent frame legs, a threaded member disposed in said second chamber of said one profiled part of at least one of said legs, fastening means disposed in generally coplanar alignment with said panel in a direction away from said panel and securing said corner angle in said first chamber of said adjacent legs, mounting means disposed adjacent an edge portion of said frame in covering relation of said opening of said second chamber, and second fastening means in generally coplanar alignment with said panel extending through said mounting means and said opening of said second chamber into locking engagement with said threaded member, said second fastening means being directed toward said panel.

2. A frame in accordance with claim 1 wherein said one of said profile parts includes a slot opening in a direction normal to the plane of said panel, and said other of said profile parts includes a leg insertable and lockable into said slot of said one of said profile parts.

3. A frame in accordance with claim 2 wherein said profile parts are formed of resilient material, said parts being snap fittedly connected responsive to insertion of said leg of said other profile part into said slot of said one profile part.

4. A frame in accordance with claim 2 wherein portions of said leg of said other profile part are disposed in overlapping relation of portions of said one profile part in the assembled condition of said parts.

5. A frame in accordance with claim 1 and including a rigid insulating block interposed between said profile parts, the spacing of said parts being a function of the thickness of said block, whereby said profile parts may be accommodated to panels of a variety of thicknesses in accordance with the thickness of said block.

* * * * *